US005125649A

United States Patent [19]

Fuller

[11] Patent Number: 5,125,649

[45] Date of Patent: Jun. 30, 1992

[54] EXERCISE APPARATUS UTILIZING A BOOSTER BAR AND SHOCK CORDS

[76] Inventor: Conrad Fuller, P.O. Box 452, Smithfield, New South Wales, Australia, 2164

[21] Appl. No.: 622,934

[22] Filed: Dec. 6, 1990

[51] Int. Cl.[5] ..... A63B 21/02

[52] U.S. Cl. ..... 482/123; 482/124; 482/145; 482/139; 482/106

[58] Field of Search ..... 272/137, 142, 136, 138, 272/139

[56] References Cited

U.S. PATENT DOCUMENTS

| | | | |
|---|---|---|---|
| 1,698,831 | 1/1929 | Tutus | 272/137 |
| 3,256,015 | 6/1966 | Perrin | 272/137 X |
| 3,524,644 | 8/1970 | Kane | 272/145 X |
| 3,747,593 | 7/1973 | Taylor | 272/142 X |
| 3,838,852 | 10/1974 | Gury | 272/137 |
| 4,195,835 | 4/1980 | Hinds et al. | 272/137 |
| 4,284,274 | 8/1981 | Boothe | 272/143 X |
| 4,733,862 | 3/1988 | Miller | 272/136 X |

FOREIGN PATENT DOCUMENTS

| | | | |
|---|---|---|---|
| 2702545 | 8/1978 | Fed. Rep. of Germany | 272/142 |
| 3157 | of 1903 | United Kingdom | 272/142 |
| 2107999 | 5/1983 | United Kingdom | 272/138 |

*Primary Examiner*—Richard J. Apley
*Assistant Examiner*—D. F. Crosby
*Attorney, Agent, or Firm*—Workman, Nydegger & Jensen

[57] ABSTRACT

The present invention is an exercise machine comprising a booster bar to which is attached a pair of flexible elastic shock cords which have their other ends attached to fixed structural members. The user exercises his arms or his legs by repeatedly pushing against the booster bar, thus stretching and unstretching the shock cords. The unstretched length of the shock cords is adjusted by rotating the booster bar about its axis, thus winding or unwinding, the shock cords around the booster bar. This, in turn, adjusts the force required to stretch the shock cords to a given dimension. The fixed structural member may be a part of a foot-stand or a cot-like backrest.

17 Claims, 9 Drawing Sheets

EXERCISE APPARATUS UTILIZING A BOOSTER BAR AND SHOCK CORDS

BACKGROUND

1. The Field of the Invention

The invention is in the field of exercise machines, particularly those intended for home use.

2. The Prior Art

The use of exercise machines has proliferated in the last decade or so. In general there are two main classifications of such machines—those primarily intended for use in a commercial sports center and those primarily intended for use in the home. Those intended primarily for use in a sports center are quite complex, are structurally heavy and bulky, are usually attached to the floor or the wall, and oftentimes have a complicated arrangement of levers, pulleys, weights, etc. Normally they may also be adjustable for different users having different physical strengths. Those intended primarily for the home are simpler, lighter, much less expensive but still adjustable to some degree.

One such exercise machine comprises flexible elastic shock cords, usually two, which are stretched by a force exerted by the user. As a cord is stretched more and more, the force required to stretch it increases more and more. One end of the shock cord is attached to a fixed structure and the other end attached to a booster bar adapted to be moved by the user's arms or legs as the cord is stretched by the user. As a natural consequence of the size of the user the stretched length of the shock cord will be substantially constant for a given user but will be different for a different user. Also as a natural consequence of the physical characteristics of shock cords the force-length curve is an inverse exponential when the force is displayed as the abscissa. Thus the maximum force required for a given user to stretch his arms or his legs to their fullest extent depends on the characteristics of the shock cord and also on the ratio of the stretched length to the unstretched length of the shock cords. Since a different user having a different physical size or strength will require a different ratio of stretched length to unstretched length it becomes necessary to provide some means for shortening or lengthening the unstretched length. This is normally effected by means of clamps; however the clamps oftentimes damage the shock cord and thus make the shock cord essentially unusable after a given number of adjustments. It would be desirable to have an arrangement whereby the unstretched length of the shock cord could be adjusted by the user without the use of clamps or tools.

BRIEF SUMMARY AND OBJECTS OF THE INVENTION

It is an object of the invention to provide a simple exercise machine intended primarily for home use for exercising the arms or legs of the user, which involves the repeated stretching and unstretching of a pair of elastic shock cords, against a countervailing force.

It is a further object of the invention to provide an adjustment means such that different users can readily and easily adjust the force required to stretch the shock cords by adjusting the unstretched lengths of the shock cords, and also where a user can make such adjustment as desired during the act of exercising.

It is a further object of the invention to provide such an adjustment wherein no clamps or other metal objects, which bear against the cord, have sharp edges or pressure points which could chafe or otherwise damage the shock cord.

The present invention comprises a pair of shock cords having their distal ends attached to a fixed attachment, and having their near ends attached to a movable booster bar, adapted to be moved by the user by stretching his arms or legs. The unstretched length of the cords can be adjusted by simply rotating the booster bar and thus winding the cords around the booster bar to any degree desired. Additionally, handgrips are applied to the bar such that the user can grasp the bar without undue difficulty being required to rotate the bar or to prevent the bar from rotating while exercising.

When the exercise machine is to be used for exercising the arms the fixed attachment normally comprises a fixed structural member, such as a rod forming part of a foot-stand. Strap loops attached to the distal ends of the shock cords are slipped over corresponding ends of the fixed rod. The user stands on the foot-stand, grasps the booster bar, rotates it so as to adjust the unstretched length of the shock cords to a desired length, and then repeatedly lifts and lowers the bar. If the force required to stretch the user's arms to their full extent is greater than desired the user simply rotates the bar in such a direction as to partially unwind the shock cords until the desired force is achieved. Conversely, if the force required is less than desired the user simply rotates the bar in the opposite direction, thus winding up the shock cords, until the desired force is achieved.

When the exercise machine is to be used for exercising the legs the fixed attachment normally comprises a fixed structural member forming a part of a cot-like backrest. Strap loops attached to the distal ends of the shock cords are slipped over corresponding ends of the structural member. The user lies down with his back on the backrest, rotates the booster bar so as to adjust the unstretched length of the shock cords to a desired length, places his feet against the booster bar, grasps an edge of the backrest, and then repeatedly stretches and unstretches his legs. As before, the force may be adjusted by winding or unwinding the shock cords by rotating the booster bar in the proper direction.

Arrangements other than those described above may be used. As an example, the user could exercise his arms by lying on the backrest, grasping the booster bar with his hands instead of pushing with his feet, and repeatedly stretching and unstretching his arms.

In still another arrangement the distal ends of the shock cords could be attached to a typical weightlifter bar with weights at each end, thus providing an arrangement whereby the user could repeatedly lift and lower the weight.

In practice it has been found that a preferred embodiment results when each shock cord comprises a 10 mm plaited nylon elastic cord approximately 46 inches (117 cm) long, the booster bar comprises a one-inch (2.54 cm) or one and one-fourth inch (3.2 cm) steel pipe approximately 36 inches (91 cm) long, and the handgrips comprise criss-crossing tape approximately 6 inches (15 cm) long.

The shock cords should be seized at each end to prevent unraveling, or conversely may be taped.

The near ends of the shock cord are attached to the booster bar by methods which guard against sharp edges or pressure points bearing against the cords which could chafe the cords, which provide positive configurations for preventing the shock cords from pulling away from the booster bar regardless of the force exerted by a user, which provide positive configurations for preventing relative circumferential movement between the booster bar and the point of attachment of the shock cords to the booster bar, and which also provide positive configurations for a user to at least partially wind the shock cords around the booster bar by rotating the booster bar about its axis.

One such method comprises utilizing a booster bar which is hollow, at least near its ends, and which has a hole near each end passing through its wall; threading the user ends of the shock cords through respective holes and out through the open ends of the booster bar; providing a first knot at the near end of each shock cord; pulling each shock cord back such that the first knot is positioned inside the booster bar adjacent the hole; and tying a second knot in each shock cord at a position adjacent the booster bar. As a variation of the method each shock cord, after having its first knot pulled back inside the booster bar, is looped around the booster bar, and passed under itself, thus providing the second knot.

An alternate method comprises utilizing a booster bar which bar has a hole, near each end, passing completely through the bar; threading the near ends of the shock cords through respective holes; providing a first knot at the near end of each shock cord adjacent the hole, and tying a second knot in each shock cord at a position adjacent the booster bar. The same variation as noted above may also be used in this configuration.

The distal ends of the shock cords are formed in terminal loops. Additional strap loops formed of webbing, such as used in seat belts, are tied thereto such as by a reef-knot, thus providing loops to attach to a fixed rod, or other structural member.

It may sometimes be found desirable to utilize four, or even more, shock cords rather than just the two as described above. In this case each shock cord would be paralleled by another. Such a situation could exist if the desired or available shock cord material was such that when stretched to the extent needed the force was less than desired. This situation could be corrected by using two pairs of shock cords, in parallel, rather than one pair.

One embodiment of this invention provides a foot-stand. The foot-stand is configured so as to provide fixed structural members, such as rods, to which the strap loops may be attached. The foot-stand also provides a structural member adapted for the user to stand on, thus providing the countervailing force. In this embodiment the user attaches the strap loops to the fixed structural member, stands on the foot-stand, adjusts the unstretched length of the shock cords, and then proceeds to exercise his, or her, arms by raising and lowering the booster bar, thus stretching and unstretching the shock cords.

Another embodiment of the invention provides a cot-like backrest. The backrest has a framework configured like a cot, with a padded and covered box-like member emplaced thereon. The backrest also provides fixed structural members, such as rods, to which the strap loops may be attached. In this embodiment the user attaches the strap loops to the fixed structural members, lies on his back on the backrest, adjusts the unstretched length of the shock cords, grasps the backrest with his hands, places his feet against the booster bar, and proceeds to exercise his legs by pushing repeatedly against the booster bar. Alternatively, the user may grasp the booster bar with his hands and exercise his arms by raising and lowering the booster bar.

In still another embodiment the invention may be employed in a weightlifting exercise. In this embodiment the terminal loops and strap loops are not employed. Instead the distal ends of the shock cords are tied around a standard weightlifter's bar having weights attached to each end. The stretched lengths of the shock cords are then adjusted such that the weights do not quite reach the floor as the user, standing erect, holds the booster bar with his arms stretched downwards.

DETAILED DESCRIPTION OF THE PREFERRED EMBODIMENTS

Figure 1:
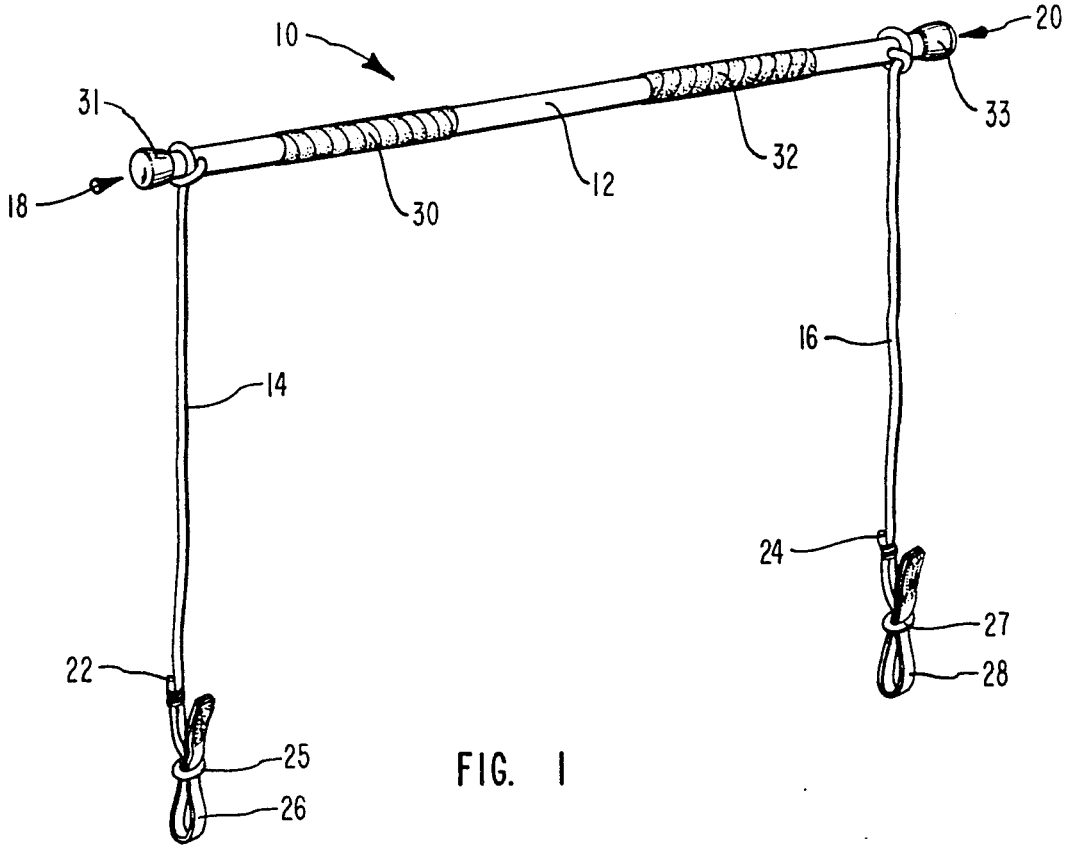
FIG. 1 is an elevation view of one preferred embodiment within the scope of the present invention.

As shown in FIG. 1 the exercise machine 10 comprises a rigid movable booster bar 12 and two flexible elastic shock cords 14 and 16. Shock cords 14 and 16 are preferably fashioned from 10 mm plaited nylon cord although other materials could be used. The essential requirement is that it have the requisite strength, and also that it be flexible and elastic enough that it can be stretched and unstretched repeatedly. Preferably the shock cord should be capable of having elastic pressure or tension applied to stretch the cord to at least two or three times its unstretched length without exceeding its elastic limit. A satisfactory material is type plaited nylon elastic shock cord manufactured by Douns & Son Samson Brand. The near ends 18 and 20 (not visible in this figure) of the cords are attached to booster bar 12 at, and near, respective opposite ends of bar 12, by means to be described later. Additionally, strap loops 26 and 28 are tied to the terminal loops 25 and 27 by means to be described later.

Booster bar 12 also has two handgrips 30 and 32 fashioned thereon, by means to be described later and also has two rubber tips 31 and 33 slid over the ends.

Booster bar 12 is preferably fashioned from a round one-inch steel pipe. Alternatively it may be fashioned from a solid bar although in this event it will be necessary, for at least one embodiment of the invention, to have coaxial holes bored in the ends so as to make the bar hollow for at least a portion of its length, as to be described later.

Figure 2:
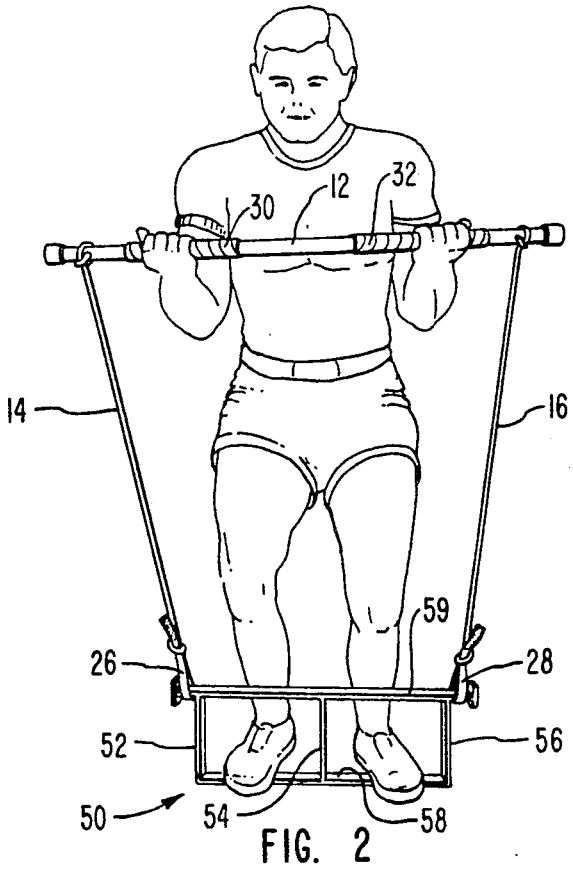
FIG. 2 is a view showing the embodiment of FIG. 1 attached to a foot-stand, together with a user beginning an exercise with the cords essentially unstretched.
Figure 3:
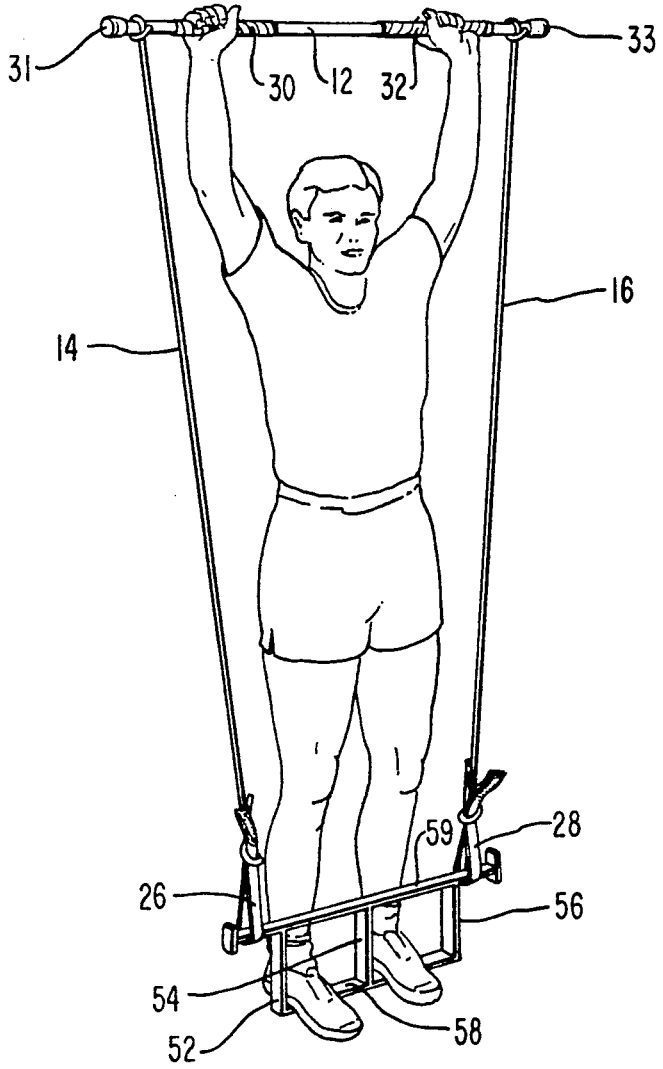
FIG. 3 is a view corresponding to FIG. 2 with the user having raised the booster bar and thus stretched the cords.

One application of the invention is shown in FIG. 2. In this application a foot-stand 50 is employed. As can be seen, the foot-stand comprises three vertical structural members 52, 54, and 56 adjoined by a flat strap 58 at their bottom ends and a bar or strap 59 adjoining their top ends, thus providing means whereby a user can stand on the flat strap 58, all as shown. Strap loops 26 and 28 are slipped over respective open ends of bar or strap 59. The open ends of bar or flat strap 59 are preferably bent so as to prevent the strap loops from slipping off. The user then grasps booster bar 12 using handgrips 30 and 32. As shown in the figure, shock cords 14 and 16 are in their unstretched configuration, but taut and ready to be stretched. The user then raises and stretches his arms as shown in FIG. 3, thus stretching the shock cords. Exercising is effected by repeatedly raising and lowering the booster bar. The force necessary to raise the bar may be increased or decreased by means to be described later.

Figure 4:
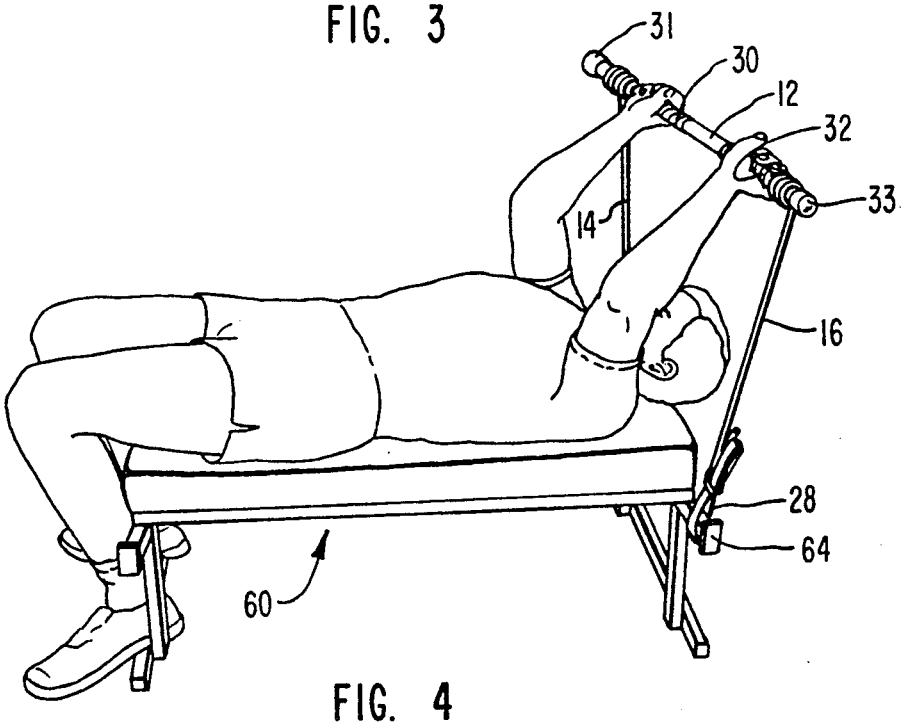
FIG. 4 is a perspective view showing the embodiment of FIG. 1 attached to a cot-like backrest, together with a user in the process of exercising his arms.

In another embodiment of this invention, as shown in FIG. 4, a cot-like backrest 60 is employed, configured as shown. Strap loops 26 (not shown) and 28 are slipped over the ends of respective straps 62 (not shown) and 64, all as depicted. The user then lies on his back on backrest 60, grasps the booster bar 12, adjusts the length of the unstretched cords 14 and 16 by rotating the booster bar 12 thus winding cords 14 and 16 around the bar as will be more fully described later. The user then raises and lowers the bar and, optionally, pushes it forwards towards his feet.

Figure 5:
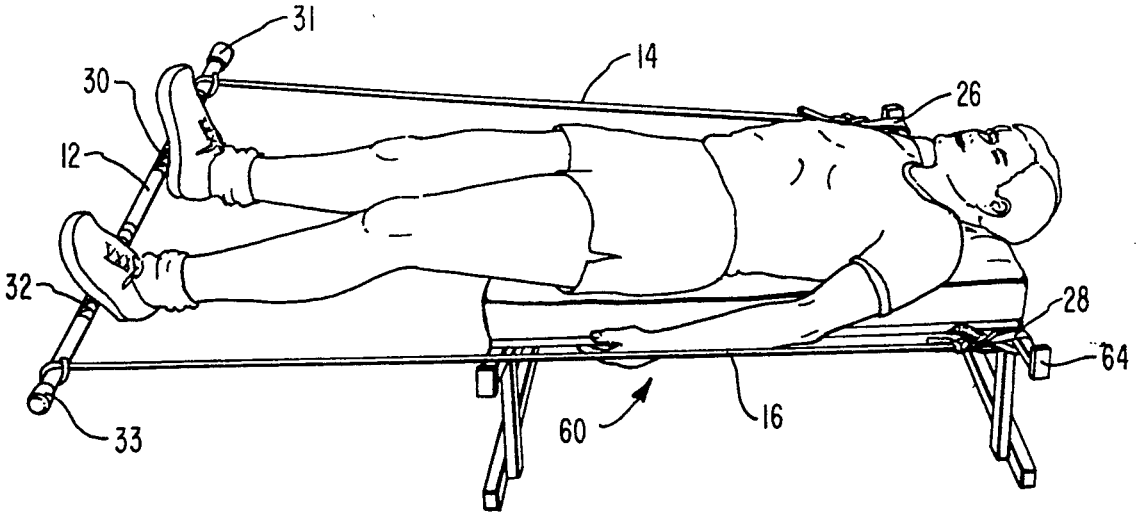
FIG. 5 is a view corresponding to FIG. 4 except that the user is exercising his legs rather than his arms.

In still another application of the invention, as shown in FIG. 5, the user uses his feet to push against the booster bar 12, rather than using his hands. In this application both the unstretched length and the stretched length of the shock cords must be greater than in the application of FIG. 4. This is effected by rotating the bar 12 so as to unwind the shock cords to a desired extent from around the bar.

Figure 6:
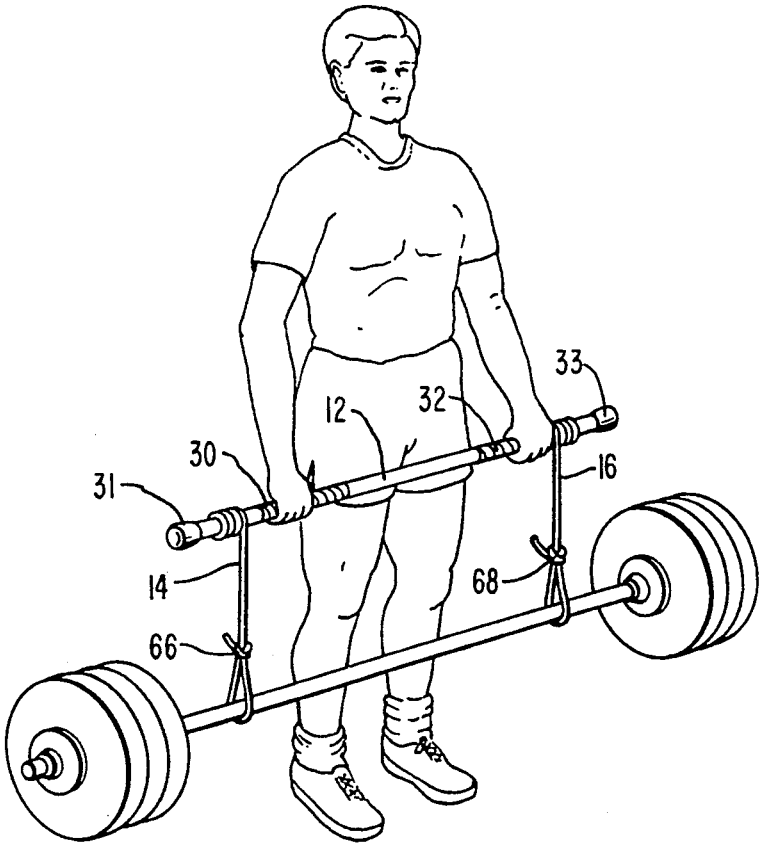
FIG. 6 is a view of another preferred embodiment within the scope of the present invention, showing a user employing the invention in a weightlifting exercise.

An alternative embodiment of the exercise machine is shown in FIG. 6. This figure depicts an arrangement whereby a weightlifter can raise and lower typical weights attached to a weight bar, these items being well known and not a part of this invention. In this embodiment the terminal loops and strap loops are slid on one end of the bar before the weights are installed or shock cords 14 and 16 have their respective distal ends tied to the weight bar, by knots 52 and 54. In this embodiment the shock cords 14 and 16 are wound around the booster bar until their stretched lengths are short enough so as to allow the weight to be lifted off the floor when the user stands erect with his arms straightened. The user then raises and lowers the assembled bar and weights.

Figure 7:
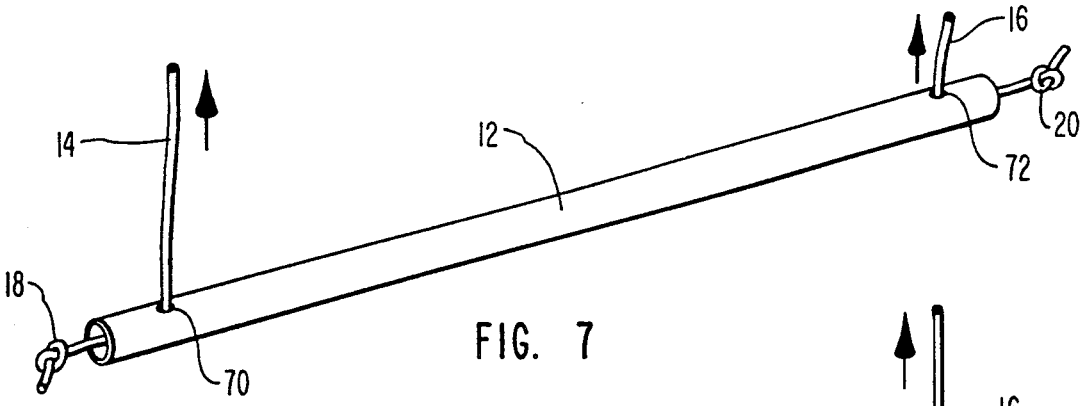
FIG. 7 is a view showing the method of assembly of the shock cords to the booster bar.
Figure 8:
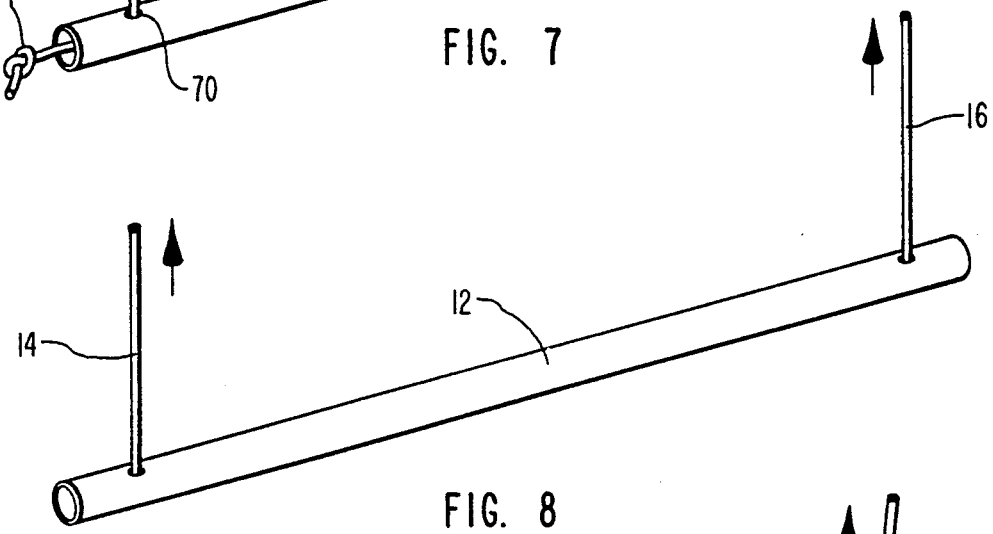
FIG. 8 is a view showing the shock cords assembled to the booster bar with the near ends pulled inside the booster bar.
Figure 9:
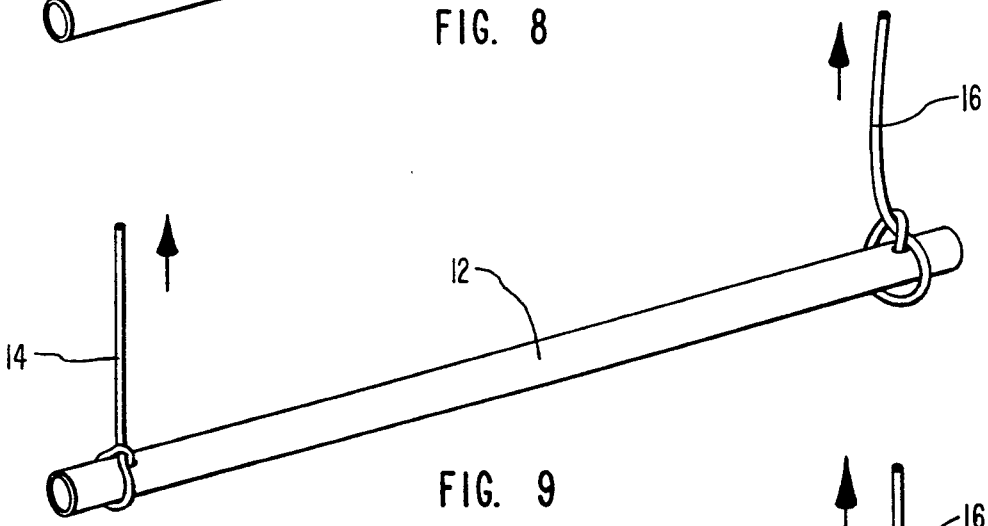
FIG. 9 is a view showing the shock cords looped around, and tied to, the booster bar.
Figure 10:
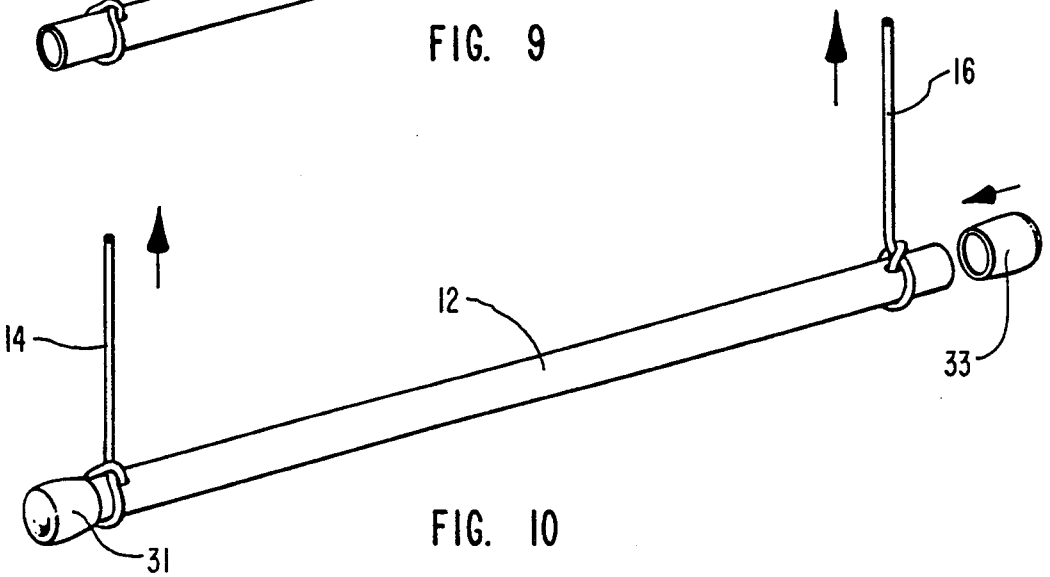
FIG. 10 is a view showing the rubber tips assembled to the booster bar.

Details of the assembly of the shock cords 14 and 16 will now be addressed. Refer to FIG. 7. Booster bar 12 is preferably hollow such as a pipe. If not hollow then coaxial bores must be effected at each end so as to make the bar hollow over at least a portion of its length from each end. Holes 70 and 72 are formed at respective ends of bar 12, as shown. These holes are sized so as to be somewhat larger than cords 14 and 16, so as to permit the cords to be easily inserted therethrough, but not any larger than necessary. The near ends 18 and 20 of the cords are then threaded through holes 70 and 72, respectively, out through the ends of the bar, and then tied in knots such as simple or overhand knots thereby forming a point of attachment of shock cords 14, 16 to booster bar 12 preventing cords 14, 16 from being pulled through bar 12. Prior to tying the knots the ends are seized or taped so as to prevent unraveling. The cords are then pulled back such that the knotted ends are inside the bar, as shown in FIG. 8. The cords are then looped around the bar, threaded through their respective loops, and pulled tight, as shown in FIG. 9. By pulling looped cords 14, 16 tight against bar 12, tension or elastic pressure applied to cords 14, 16 is prevented from being transferred to the point of attachment (shown in FIG. 7 at 70) of cords 14, 16 to bar 12. In addition, looping cords 14, 16 around bar 12 imparts a natural wind-up tendency of cords 14, 16 to begin winding around bar 12. Thus, before winding cords 14, 16 around bar 12, cords 14, 16 are situated in a natural wind-up position. Rubber tips 31 and 33 are then slid over the ends of the bar as shown in FIG. 10.

Figure 11:
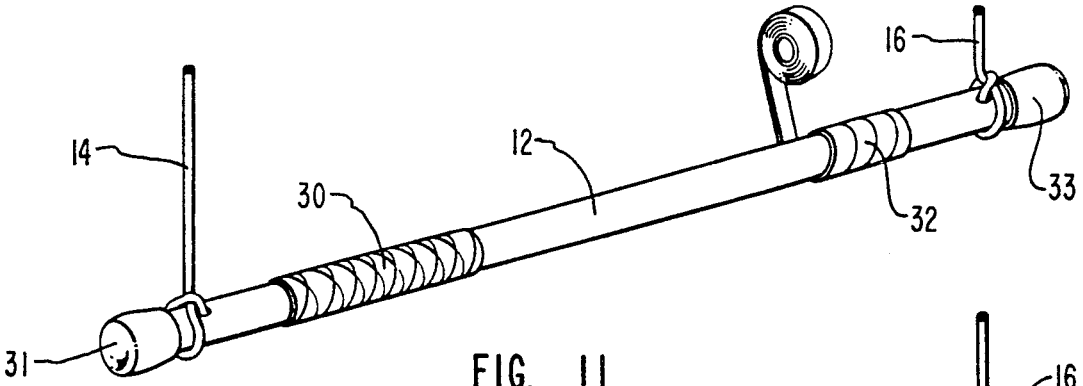
FIG. 11 is a view showing the method of assembling the handgrips to the booster bar.
Figure 12:
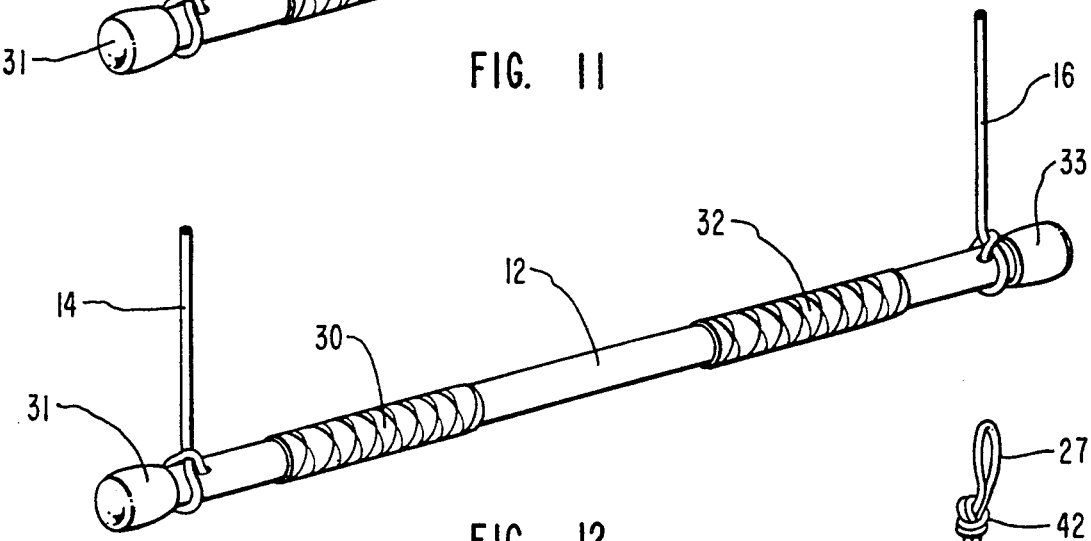
FIG. 12 is a view showing the handgrips assembled to the booster bar.

Two handgrips 30 and 32 are then fashioned on the bar, as shown in FIG. 12, by wrapping tape around the bar, as shown in FIG. 11. The tape is spiraled first in one direction and then spiraled back over itself in the opposite direction. The handgrips are each normally six inches (15.2 cm) long and spaced six inches (15.2 cm) from corresponding ends of the bar.

Figure 13:
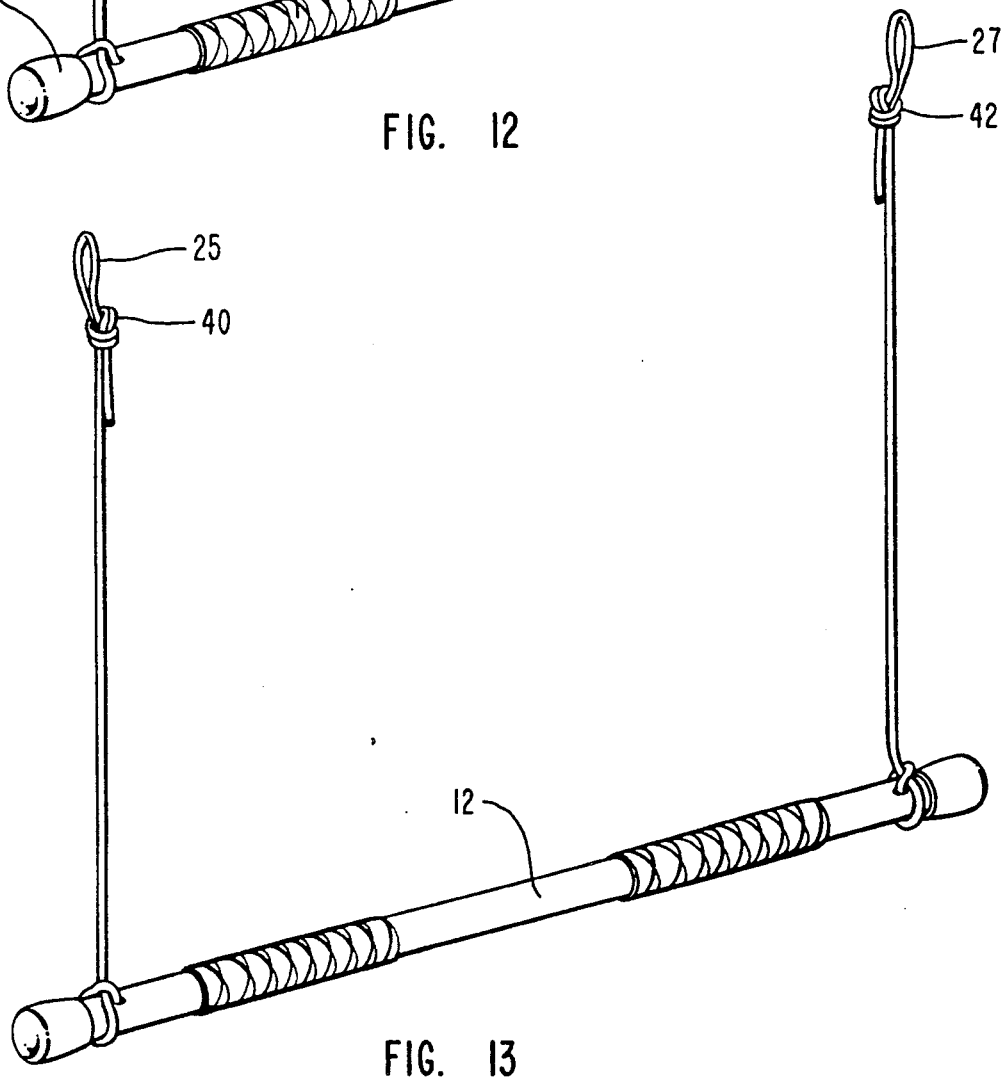
FIG. 13 is a view showing the terminal loops fashioned at the distal ends of the shock cords.

Terminal loops 25 and 27 are then formed on the respective distal ends of the shock cords as shown in FIG. 13. The loops are secured by means of square knots 40 and 42.

Figure 14:
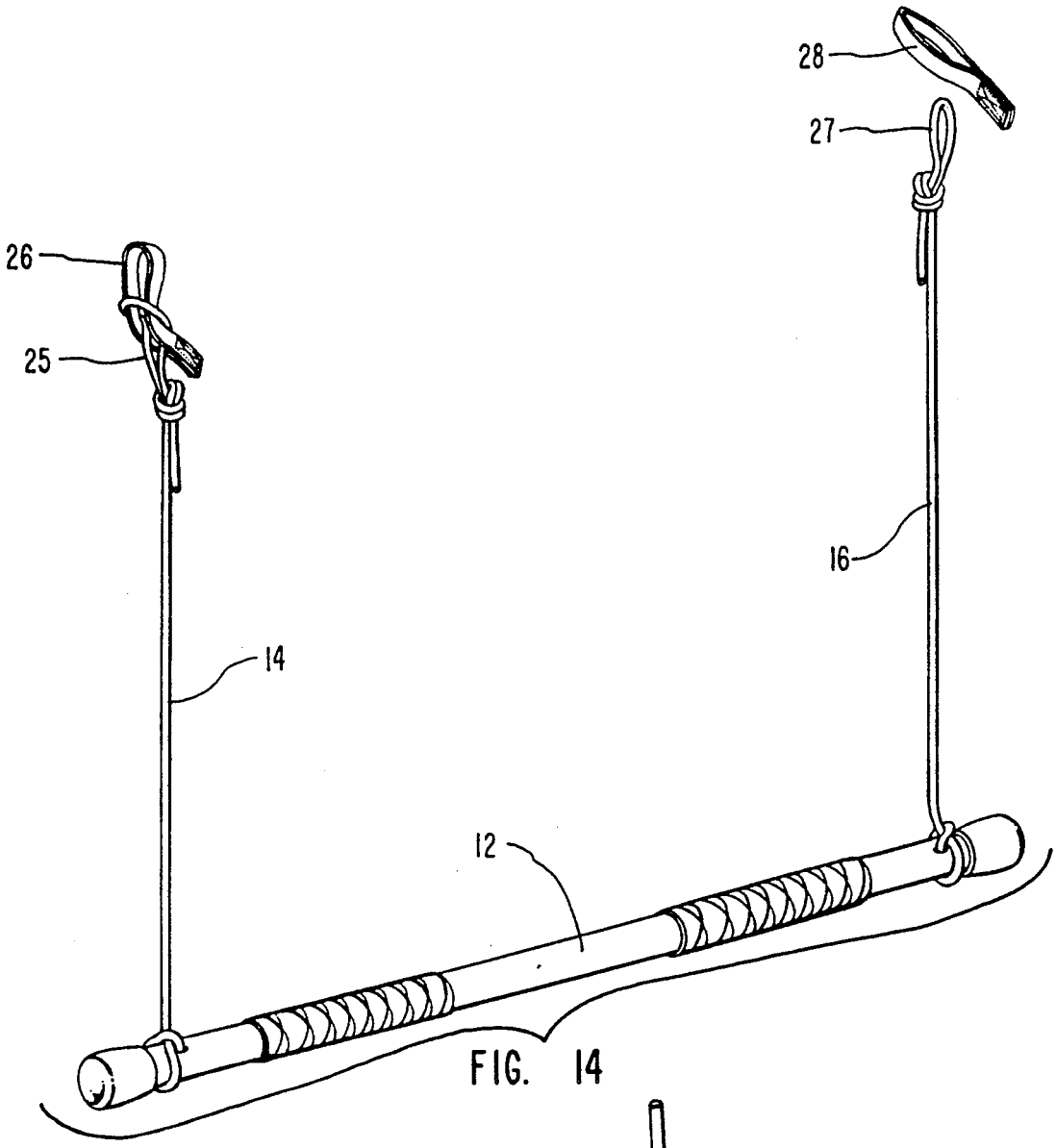
FIG. 14 is a view showing the method of assembling the strap loops to the terminal loops.
Figure 15:
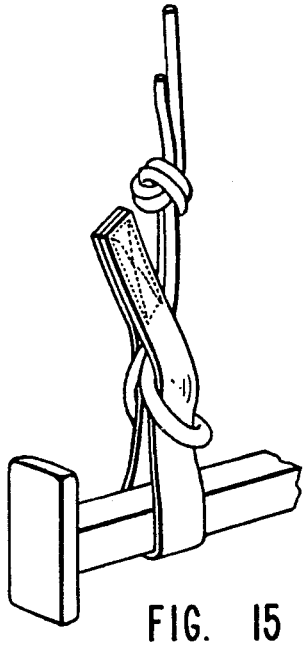
FIG. 15 is a view showing a strap loop assembled to a terminal loop, drawn to a larger scale.

Strap loops 26 and 28 (FIG. 14), are fashioned from webbing such as is used in seat belts. They are then attached to terminal loops 25 and 27 by tying the two corresponding straps together in a fashion similar to a square or reef-knot, as shown in FIG. 15.

Figure 16:
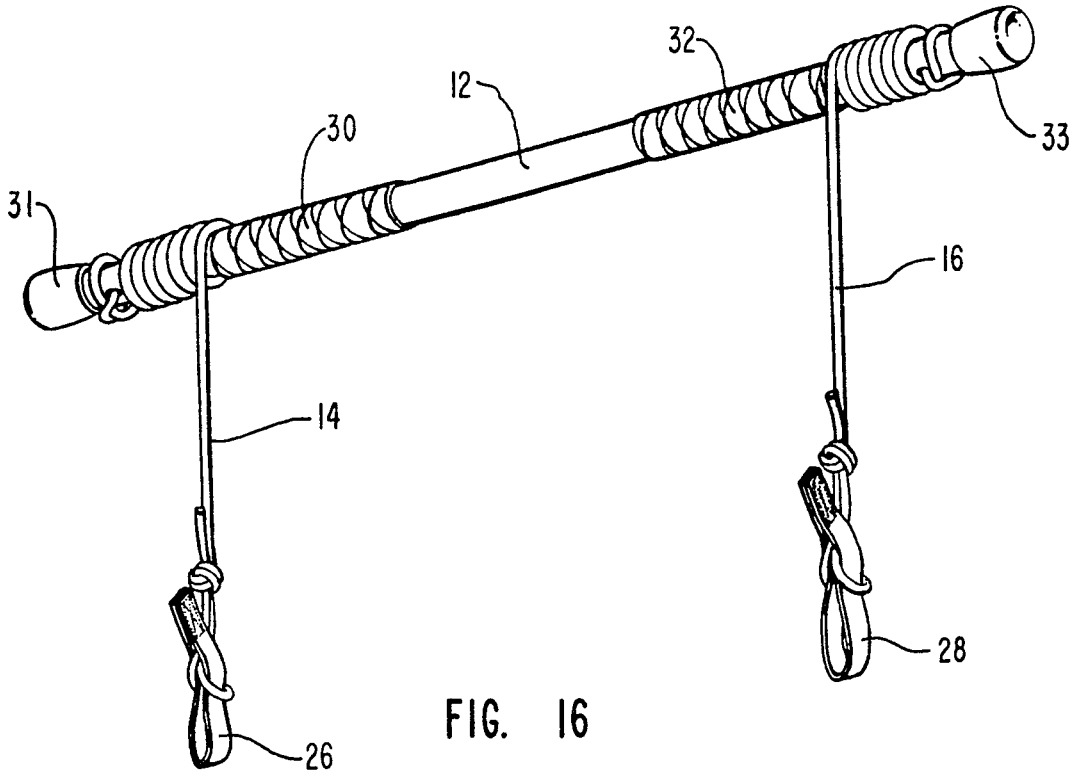
FIG. 16 is a view showing the shock cords wound with several turns around the booster bar.

The unstretched length of the cords may be shortened by rotating the booster bar, thus winding up the cords, as shown in FIG. 16.

Figure 17:
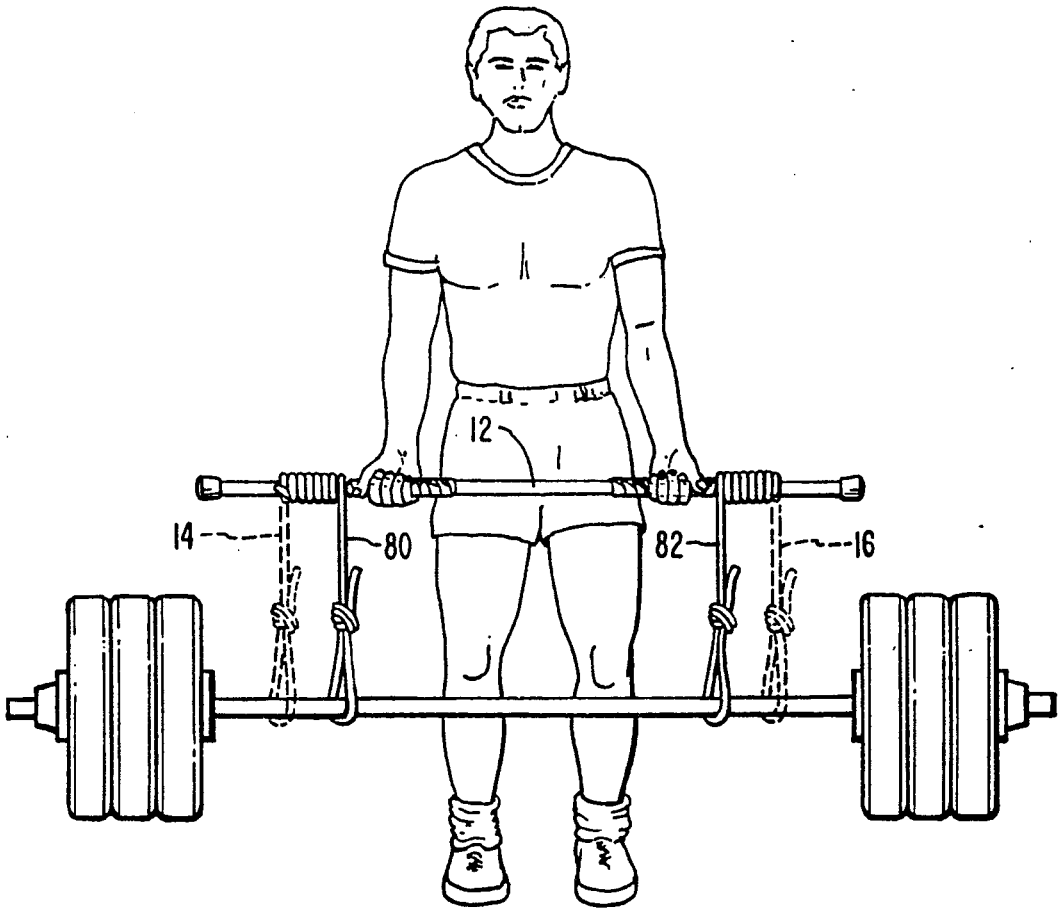
FIG. 17 is a view showing another embodiment of the invention arranged for weightlifting similar to FIG. 6 except employing two pairs of shock cords.

As noted previously there may be situations where it would be preferable to use more than one pair of shock cords. An embodiment utilizing two pairs of shock cords is shown in FIG. 17. This is similar to FIG. 6 except that a second pair of shock cords, 80 and 82, is employed. The near ends of shock cords 14 and 16 are attached to the booster bar 12 as described previously.

The distal ends of cords 14 and 16 are tied to the weight bar by square knots.

Figure 18:
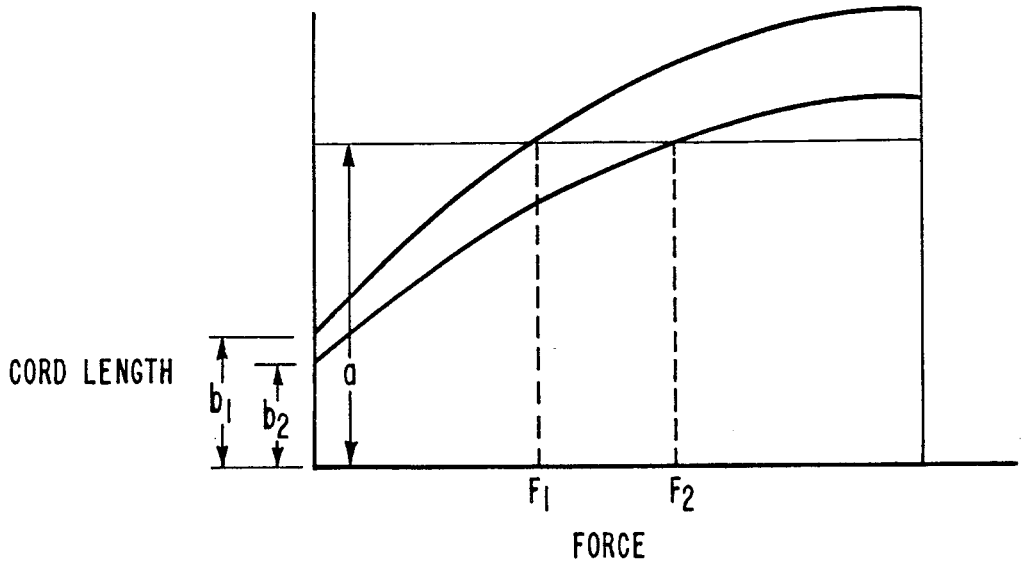
FIG. 18 is a graph showing the relationship between force and length of shock cord for two different initial unstretched lengths.

In all embodiments, except those of FIGS. 6 and 17, the force required to stretch the cords can be increased or decreased by winding or unwinding the cords around the booster bar. As the cords are wound around the bar the unstretched lengths are decreased which results in a larger elastic pressure being required to stretch the cords to a given dimension. This is shown schematically in FIG. 18 where cord length is plotted as ordinate and elastic pressure or force is plotted as abscissa. Two different situations are depicted wherein the stretched length is "a" and the unstretched length is "b," for one situation and "$b_2$" for the second situation. As can be readily seen, when "$b_2$" is less than "b," the force "$F_2$" is greater than the force "F," required to achieve the same stretched length "a."

Figure 19:
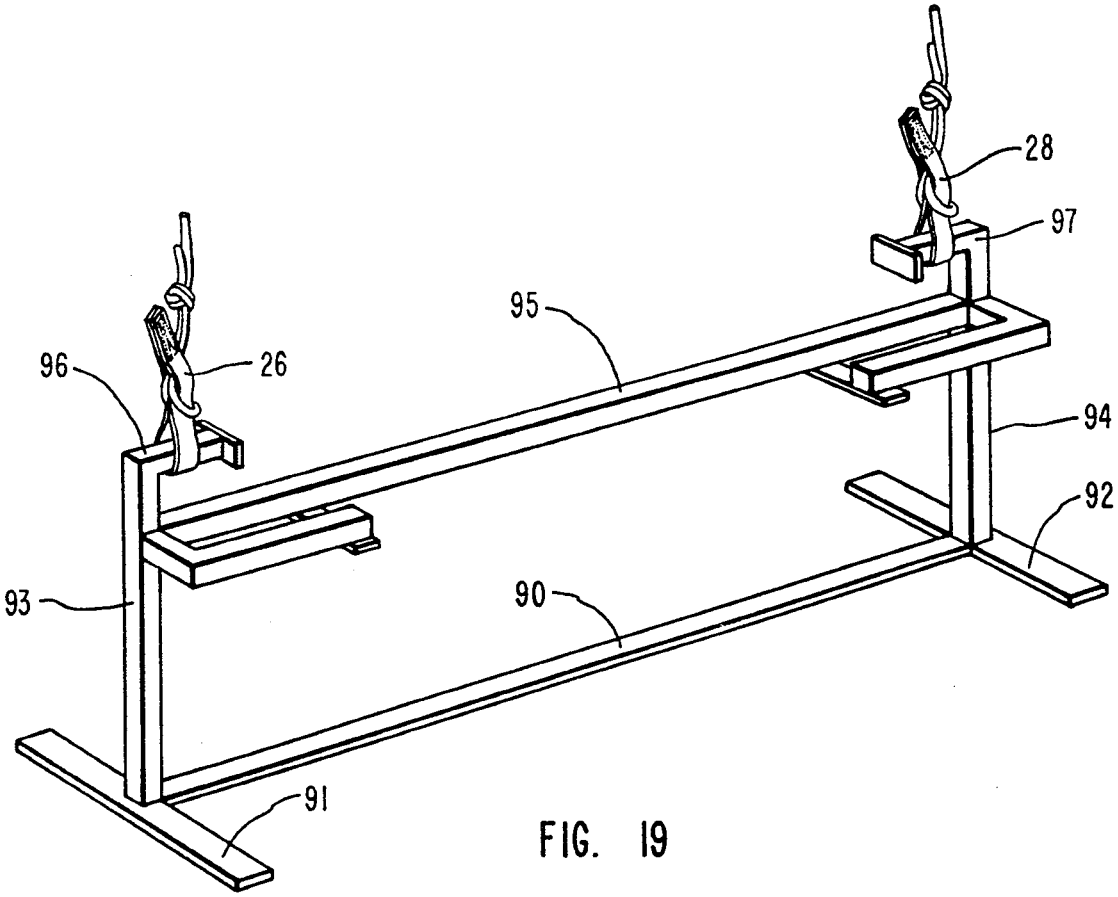
FIG. 19 is a perspective view of one embodiment of the foot-stand.

As noted above, the embodiment of FIGS. 2 and 3 utilizes a foot-stand. A foot-stand somewhat different than that of FIGS. 2 and 3 is shown in FIG. 19. In this embodiment a longitudinal flat strap 90 is employed as a structural member for the user to stand on. Strap 90 has structural members 91 and 92, also flat straps, welded at its respective ends, and at right angles, as shown. Members 90, 91, and 92 comprise the bottom of the foot-stand. Posts 93 and 94 vertically oriented, are also welded at respective ends of strap 90. A structural member 95 then adjoins the tops of posts 93 and 94, thus holding them in fixed position and also serving as the top of the foot-stand. Members 96 and 97 then serve to hold the strap loops 26 and 28.

Figure 20:
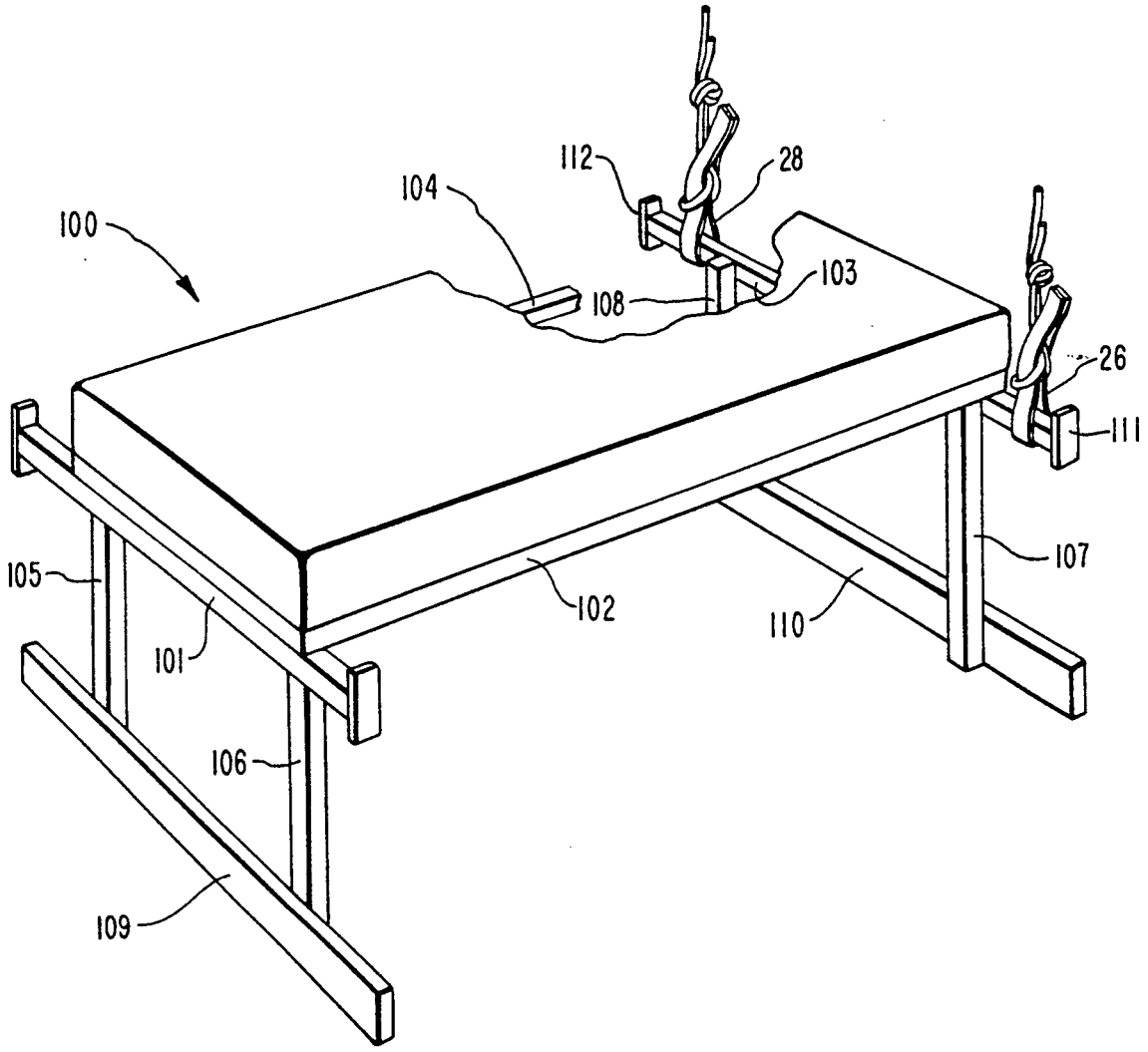
FIG. 20 is a perspective view of one embodiment of the backrest.

As noted above the embodiment of FIG. 4 is a cot-like backrest. One such embodiment of a backrest is shown in FIG. 20. As shown a cot-like framework, 100, is formed from structural members 101, 102, 103, and 104 which serve as the top; structural members 105, 106, 107, and 108 which serve as legs; and structural members 109 and 110 which serve as bottom supports that rest on the floor. Members 111 and 112 which comprise rods or metallic straps, serve to hold and secure strap loops 26 and 28.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An exercise machine comprising:

a rigid movable booster bar;

two flexible elastic shock cords having near ends and distal ends, each cord being capable of being stretched to a length substantially greater than its unstretched length without exceeding its elastic limit, and wherein the force required to stretch the cord increases as the cord is stretched;

means for attaching the near ends of said elastic shock cords to said booster bar, at or near respective ends of said booster bar, comprising positive means for preventing said shock cords from pulling away from said booster bar, positive means for preventing relative circumferential movement between said booster bar and the point of attachment of said shock cords to said booster bar, and also positive means for a user to at least partially wind or unwind said shock cords around said booster bar by rotating said booster bar about its axis, said means configured such that said shock cords are attached to said booster bar in a natural wind-up position such that there is an even loading on both ends of the bar, the area of elastic pressure on the shock cords being displaced from the point of attachment of the shock cords to the booster bar along the length of the shock cords.

2. An exercise machine as defined in claim 1 comprising, further, means for attaching the distal ends of the shock cords to a fixed and rigid member.

3. An exercise machine as defined in claim 1 comprising further one or more handgrips intermediate the length of the booster bar.

4. An exercise machine as defined in claim 1 wherein each shock cord comprises a cord capable of being stretched to a dimension at least twice its unstretched length.

5. An exercise machine as defined in claim 4 wherein each shock cord comprises a plaited nylon elastic cord.

6. An exercise machine as defined in claim 5 wherein each shock cord has a diameter of approximately 10 mm.

7. An exercise machine as defined in claim 1 so configured that each cord winds up around the booster bar as said booster bar is rotated about its axis, thus shortening the unstretched length of the cord between said booster bar and its distal end, and thereby increasing the force necessary to stretch the cord to a given dimension.

8. An exercise machine as defined in claim 1 wherein the booster bar is hollow for at least a portion of its length at each end.

9. An exercise machine as defined in claim 8 wherein the booster bar comprises a round pipe.

10. An exercise machine as defined in claim 9 wherein the booster bar is a steel pipe having a diameter of approximately 1 inch (2.54 cm) or 1¼ inch (3.2 cm).

11. An exercise machine as defined in claim 1 wherein the booster bar is a solid bar.

12. An exercise machine as defined in claim 8 wherein the means for attaching the near ends of the elastic shock cords to the booster bar, at or near respective ends of said booster bar, comprises a hole passing through a wall of said booster bar near each end of said booster bar, sized large enough so as to allow the near end of the elastic shock cord to pass easily therethrough, but small enough so as to prevent a knot tied in said shock cord from passing therethrough; a knot tied at the near end of said shock cord and positioned inside said booster bar; and a second knot tied in said shock cord and positioned adjacent the outer surface of said booster bar.

13. An exercise machine as defined in claim 12 wherein each shock cord is attached to the booster bar such that the near end of said shock cord is looped around said bar, is threaded through the loop, pulled tight, passed through the hole in said bar, and is tied in a knot.

14. An exercise machine as defined in claim 12 further comprising rubber tips which encompass the ends of the booster bar.

15. An exercise machine as defined in claim 2 comprising two handgrips fashioned intermediate the length of the booster bar.

16. An exercise machine as defined in claim 15 wherein each handgrip comprises tape spiralled around, and secured to, the booster bar.

17. An exercise machine as defined in claim 16 wherein the tape is spiralled so as to progress first in one direction along the booster bar and then back over itself in the reverse direction along said bar.

* * * * *